US005179992A

United States Patent [19]

Okarski et al.

[11] Patent Number: 5,179,992

[45] Date of Patent: Jan. 19, 1993

[54] SELF CONTAINED REMOVABLE SUNSHADE FOR THE EXTERIOR OF CURB-MOUNTED SKYLIGHTS

[76] Inventors: Steven E. Okarski; Scott E. Okarski; Carol Okarski-Lawlor, all of 128 Cedarwood Village Cir., Daytona Beach, Fla. 32119

[21] Appl. No.: 755,750

[22] Filed: Sep. 6, 1991

[51] Int. Cl.[5] ..... A47H 23/00

[52] U.S. Cl. ..... 160/327; 160/90; 160/368.1

[58] Field of Search ..... 160/327, 90, 368.1; 5/496, 499, 501, 498; 52/202, 200

[56] References Cited

U.S. PATENT DOCUMENTS

| | | | |
|---|---|---|---|
| 1,195,874 | 8/1916 | Thurston | 5/498 X |
| 1,833,298 | 11/1931 | Oakey | 5/498 X |
| 2,241,466 | 5/1941 | Lovick | 5/498 X |
| 2,727,253 | 12/1955 | Tomsic | 5/496 |
| 4,461,047 | 7/1984 | Hammond | 5/496 X |
| 4,606,290 | 8/1986 | Marzotto | 5/499 X |

*Primary Examiner*—Blair M. Johnson

[57] ABSTRACT

A thin, flat, body of woven mesh shading screen (10) having eight grommets (12), two at each corner set on edges of sunshade, and four pieces of rubber bungee (14) communicating with and affixed to grommets. By matter of virtue, rubber bungee is extremely flexible, allowing for the bungee to be stretched at each of the four corners around each of the four exterior corners of a skylight for attachment.

4 Claims, 1 Drawing Sheet

SELF CONTAINED REMOVABLE SUNSHADE FOR THE EXTERIOR OF CURB-MOUNTED SKYLIGHTS

BACKGROUND

1. FIELD OF INVENTION

This invention relates to skylight shading covers, specifically covers designed in such a manner that they directly attach to the exterior flange of curb-mounted skylights.

2. DESCRIPTION OF PRIOR ART

Many homes and office buildings around the country built since the late 1960's were constructed with a design feature similar to a window, located in the roof, commonly known as a skylight. Skylights are also sold in "ready to install" aftermarket kits. These kits are found in hardware chain store outlets throughout the nation, and enable a person to equip their home or office with a skylight if one was not originally installed.

While skylights enhance the beauty of living area and are quite functional in producing added light, they also provide for many undesirable side effects. Skylights are known to transmit excessive heat into a living area, and provide a pathway for solar rays to cause interior damage such as the fading of carpets, rugs, furniture and wallhangings.

To this point some manufacturers of skylights have attempted to combat the transmittance of excess light and heat by incorporating roll down shade devices or miniblinds on the interior side of a skylight. While these techniques may have some merit, they are found only in the most expensive skylight kits. In addition, the need to adjust these types of shades can prove to be a troublesome, incovenient task, requiring the use of a turn rod to reach the skylight, or unsightly draw cords which extend downward from the skylight. Also, while these interior shading methods may provide a degree of relief, it is known that for the reduction of heat, it is seven times more effective to filter light before it enters a living space via windows or skylights. Thus, once the lightheat penetrates a skylight, an interior shade cannot be nearly as effective in stopping the spread of this heat since it has already invaded the living space.

Some other disadvantages of present applications are:

(a) An interior shade of the type discussed can only block or redirect light, while doing almost nothing to reduce heat transmission.

(b) An interior shade does not block solar heat from entering living space as it is not positioned on the exterior of the skylight.

(c) An interior shade requires additional hardware and manipulation to adjust.

(d) Manufacturers of skylights with interior shade devices demand a very high price for their product making it cost prohibitive for purchase by contractors and developers of average priced buildings, and well as by the "Sunday-do-it-yourselfer".

OBJECTS AND ADVANTAGES

Accordingly, besides the obvious advantages of an exterior skylight sunshade, several objects and advantages of this invention are:

(a) to provide a self contained skylight sunshading system which may be affixed on the exterior of curb-mounted skylights requiring no additional nailing or framing for attachment;

(b) to provide a skylight sunshade which will reduce solar heat transmission by up to 78% depending on material utilized;

(c) to provide a skylight sunshade which protects home furnishings and carpets from colorfade;

(d) to provide a skylight sunshade which reduces home cooling costs by reducing solar heat gain;

(e) to provide a skylight sunshade which provides ample lighting while filtering undesirable glare;

(f) to provide a skylight sunshade utilizing attachment features which allow for easy removal in case heat gain is desired during cooler winter months;

(g) to provide a skylight sunshade which is visually unobtrusive so as not to violate uniform appearance codes of condominium or homeowner associations;

(h) to provide a skylight sunshading system which requires no manipulation or adjustments once installed;

(i) to provide a skylight sunshade which provides a virtually unobstructed outward view; and (j) to provide a skylight sunshade which blocks solar heat entry from the most effective point which is the exterior of the skylight.

Further objects and advantages are to provide a skylight sunshade which can be used easily and without damage to the skylight, and is inexpensive to manufacture. Further objects and advantages of our invention will become apparent from a consideration of the drawings and ensuing description herein.

DRAWING FIGURES

In the drawings, closely related figures have the same number.

REFERENCE NUMERALS IN DRAWINGS

10 sunshade material
12 grommets
14 rubber bungee cord

Figure 1:
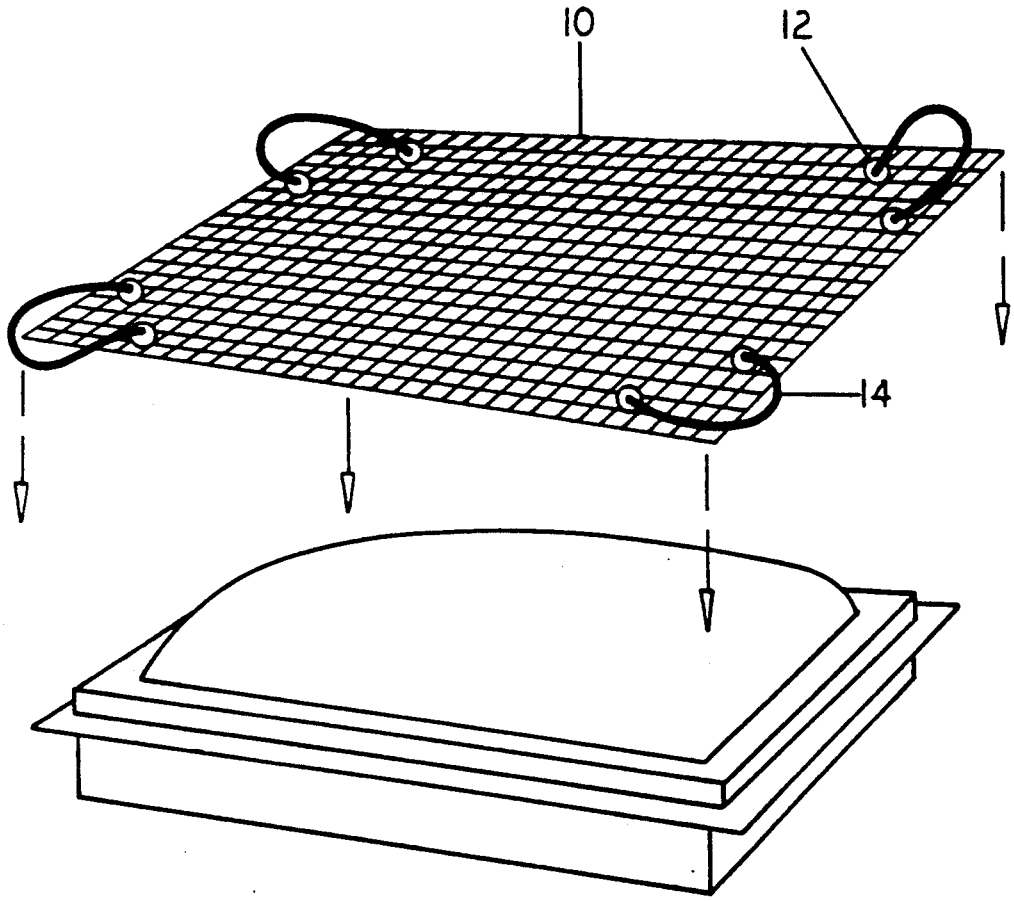
FIG. 1 shows a skylight sunshade before attachment to skylight.
Figure 2:
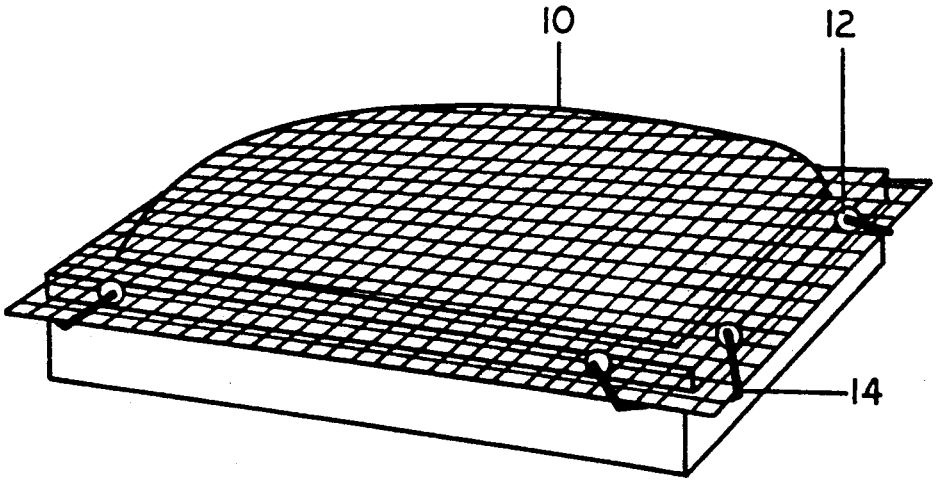
FIG. 2 shows a skylight sunshade after attachment to skylight utilizing four-corner attachment system.

DESCRIPTION-FIGS. 1 and 2

A typical embodiment of the sunshade of the present invention is illustrated in FIG. 1 (unattached view) and FIG. 2 (attached view).

The skylight sunshade consists of a thin, flat, flexible, durable screening material with solar shading properties to block solar heat and light rays from entering a living area. The sunshade size is determined by adding 20 centimeters (cm) to both the exterior length and width dimensions of the skylight. In the preferred embodiment, the sunshade is a black-colored vinyl-coated polyester 17×12 woven mesh, available from Phifer Wire Products, Inc., of Tuscaloosa, Ala. However, the sunshade material can consist of any material that will block solar heat and light rays thereby reducing heat transmission, cooling costs and colorfade; be of open weave design to provide ample lighting and allow outward visibility; resist corrosion under continuous direct exposure to solar rays; and flex to facilitate installation and snug fit.

At each corner of the sunshade are two grommets set equidistant (18 cm) from respective corners, at a prescribed distance (5 cm) from sunshade material edge. In the preferred embodiment, grommets are 100% brass to resist corrosion and are #2 sized, available from PCI Group, Inc., of New Bedford, Mass. However, grommets can consist of any material that will penetrate and affix to sunshade material in a rigid manner for purpose of securing bungee, resist corrosion and withstand continuous direct exposure to solar rays.

Each piece of bungee shall transmit through a corresponding pair of grommets to facilitate sunshade attachment to skylight. Each bungee length is 33 cm. In the preferred embodiment, bungee is 0.635 cm wide, 100% natural rubber encased in black-colored nylon to resist corrosion and withstand continuous direct exposure to solar rays, available from Sea Ties, Inc., Baton Rouge, La. However, bungee or any chosen fastening fabric tie can consist of any material that will flex, stretch, resist corrosion and withstand continuous direct exposure to solar rays.

There are various possibilities with regard to the specific sunshade, grommet and bungee/tie material used. Materials chosen will affect the amount of solar ray blockage, outward visibility, fit, appearance (color), and product longevity.

From the description above, a number of advantages of our skylight sunshade become evident:

(a) Sunshade is self contained and requires no additional nailing or framing for attachment to curb-mounted skylights.

(b) Sunshade will reduce solar heat transmission thereby reducing cooling costs.

(c) Sunshade will reduce solar light transmission thereby reducing colorfade on home furnishings.

(d) Sunshade will allow ample lighting while filtering undesirable glare.

(e) Sunshade will allow easy removal if heat gain is desired during cooler winter months.

(f) Sunshade is visually unobtrusive so as not to violate uniform appearance codes of condominium or homeowner associations.

(g) Sunshade will not require manipulation or adjustment once installed.

(i) Sunshade provides a virtually unobstructed outward view.

(j) Sunshade will block solar heat entry from the most effective point, the exterior of the skylight.

OPERATION-FIGS. 1 AND 2

The installation of the self contained, removable exterior skylight sunshade can be achieved in a few relatively simple steps. Namely, one first is suggested to wipe exterior dome of skylight with a damp cloth to remove any dirt, grit, etc., that may promote abrasion of the skylight or sunshade after installation. Next, one would place the sunshade 10 over the skylight dome with the bungee loops 14 facing upward, while also allowing uniform overhang of sunshade 10 at each side of skylight. Then, while holding sunshade 10 firmly in place, one would grip the bungee 14 handle and stretch it around respective corner of skylight. This action will wrap corner of sunshade 10 under skylight flange, while at the same time securing said corner to skylight. This step is repeated for remaining three corners. Finally, to achieve snug, secure fit, one revisits each corner one at a time, and stretches bungee 14 back over corner (thus removing it) while gripping bungee 14 so as to keep sunshade 10 pulled taut. One would then pull the sunshade corner 10 as tightly as possible, neatly tucking sunshade corner 10 under skylight flange and then reattaching bungee 14. This procedure is then repeated for remaining three corners. When these steps are followed, a snug, secure, neat installation is achieved, as shown in FIG. 2.

To remove sunshade from skylight, one simply stretches the bungee 14 over skylight corner, thus detaching the sunshade 10. This is done at each of the three remaining corners, at which time removal will be completed.

By virtue of the attachment design, as well as materials used, sunshade may be installed and removed as desired, causing little or no wear on the sunshade itself and none to the skylight.

SUMMARY, RAMIFICATIONS, AND SCOPE

The present invention comprehends a self contained removable sunshade for the exterior of curb-mounted skylights wherein a woven mesh design shading screen is fitted with grommets and rubber bungee cord in such a manner as to allow it to be securely attached, covering the dome of a curb-mounted skylight.

Accordingly, the reader will see that the removable, self contained exterior sunshade screens for curb-mounted skylights of this invention can be used to cover skylights in homes, office buildings and warehouses easily and quite conveniently. They can be just as simply installed on pre-existing skylights as they can be on aftermarket, or yet to be constructed skylights of the curb type. Furthermore, this specific combination of material and design possesses additional advantages in that:

it can contribute to the reduction of cooling costs of whatever type of home or building upon which it is installed by blocking up to 78% of solar heat transmitted;

it provides protection of carpet and furniture as well as all other furnishings from colorfade by blocking solar rays;

it provides for easy removal for heat gain during cooler winter months by virtue of its reliance on a design that requires no additional nailing or framing for it's installation;

it provides an added layer of acoustic insulation that actually helps dampen the earsplitting echo of rainfall on skylights;

it provides ample lighting while filtering undesirable glare otherwise allowed into living area by unprotected skylights;

it allows an extremely snug and secure fit over skylights which makes it visually unobtrusive, so as not to violate uniform appearance codes that have been adopted by many condominium and homeowner associations; and it provides a virtually unobstructed outward view from inside a home or building upon which it is installed.

Although the description above contains many specificities, these should not be misconstrued as limiting the scope of the invention, instead, they merely provide illustrations of some of the presently preferred embodiments of this invention. For example, the skylight sunshade in addition to being adaptable to nearly any size conventional, square or rectangular skylight, can also be manufactured for custom application shapes such as trapezoidal and triangular. Furthermore, by substituting the black color woven mesh normally used with a different color woven mesh thus enables the invention to still achieve above advantages in addition to adding aesthetic value inside the home or building upon which it is installed. For instance, installing a skylight sunshade of bronze colored woven mesh on a structure with a predominantly white colored interior will cast a soft reddish glow and figuratively "warm up" an otherwise dour surrounding.

Thus, the scope of the invention should be determined by the range allowed by the appended claims and their equivalent, rather than solely on the basis of examples given.

We claim:

1. A skylight sunshade comprising:

a thin, flat, flexible sheet of screening material, said sheet having an open weave design to permit ample lighting and outward visibility therethrough while also providing solar shading properties;

said sheet having at least one pair of apertures located near an edge thereof;

at least one elastic cord having ends extending through each of the holes of each said pair of holes, thereby forming a loop, whereby, said sheet is adapted to by placed over a skylight with said loop extending over an edge portion thereof thereby securing said sheet to said skylight.

2. A skylight sunshade according to claim 1, wherein said sheet has a plurality of corners, said at least one pair of apertures and corresponding cord comprises a pair of apertures and cord at each of said corners.

3. A skylight sunshade according to claim 1, wherein each of said apertures is reinforced with a grommet.

4. A skylight sunshade according to claim 2, wherein said sheet is rectangular.

* * * * *